US005605426A

United States Patent [19]

Werner

[11] Patent Number: 5,605,426

[45] Date of Patent: Feb. 25, 1997

[54] APPARATUS FOR BINDING SHEET-LIKE ARTICLES

[76] Inventor: Richard S. Werner, 326 Cedar Sauk Rd., West Bend, Wis. 53095

[21] Appl. No.: 384,824

[22] Filed: Feb. 7, 1995

Related U.S. Application Data

[63] Continuation-in-part of Ser. No. 298,781, Aug. 31, 1994, which is a continuation-in-part of Ser. No. 231,425, Apr. 22, 1994, abandoned.

[51] Int. Cl.[6] ..... B42B 5/00

[52] U.S. Cl. ..... 412/9; 412/33; 281/21.1

[58] Field of Search ..... 412/25, 9, 33, 412/36, 901; 281/21.1; 29/281.1, 79; 269/900; 211/72, 135

[56] References Cited

U.S. PATENT DOCUMENTS

| | | | |
|---|---|---|---|
| 770,587 | 9/1904 | Kling | 412/9 X |
| 2,174,715 | 10/1939 | Baker | 211/72 X |
| 3,188,114 | 6/1965 | O'Brien et al. | 281/21.1 |
| 3,825,963 | 7/1974 | Abildgaard et al. | 412/901 |
| 4,196,835 | 4/1980 | Schlough | 412/33 X |
| 4,518,296 | 5/1985 | Pearson et al. | 412/36 |
| 4,793,633 | 12/1988 | Rose, Jr. | 281/20 |
| 4,941,791 | 7/1990 | Iwamoto | 281/21.1 |

OTHER PUBLICATIONS

Miller's Office Products (1994), p. 216.

*Primary Examiner*—Peter Vo
*Assistant Examiner*—Khan V. Nguyen
*Attorney, Agent, or Firm*—Jansson & Shupe, Ltd.

[57] ABSTRACT

An apparatus is disclosed for supporting a group of sheet-like articles such as photos or documents for binding. The apparatus includes first and second holding members defining a first slot therebetween. This first slot has a first fixed dimension. The apparatus also includes a third holding member spaced from the second holding member and defining a second slot therebetween. The second slot has a second fixed dimension. The holding members preferably extend away from a base member. Additionally, the apparatus can include a back member extending across the holding members. The apparatus can be used to align the edges of the articles and support the articles for binding.

7 Claims, 6 Drawing Sheets

FIG. 1
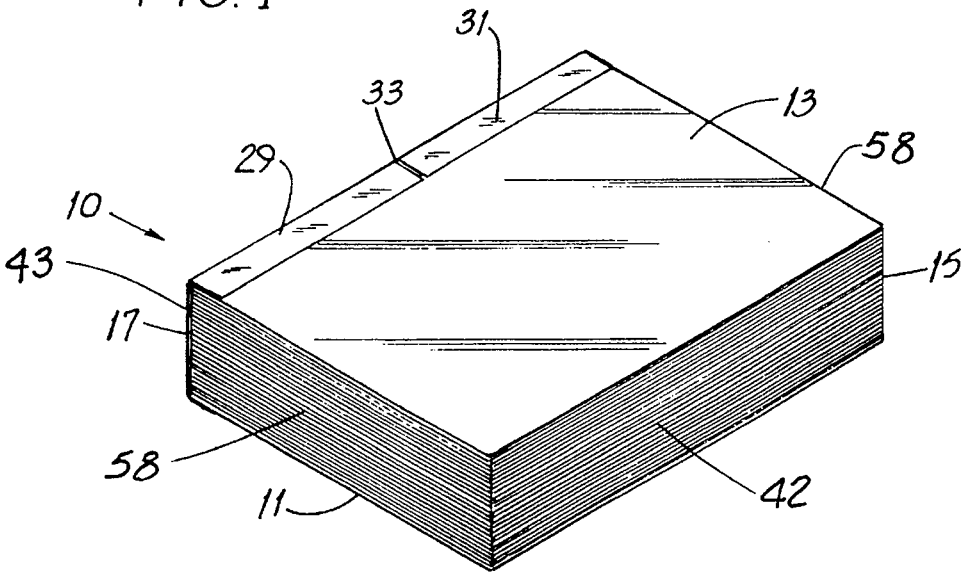
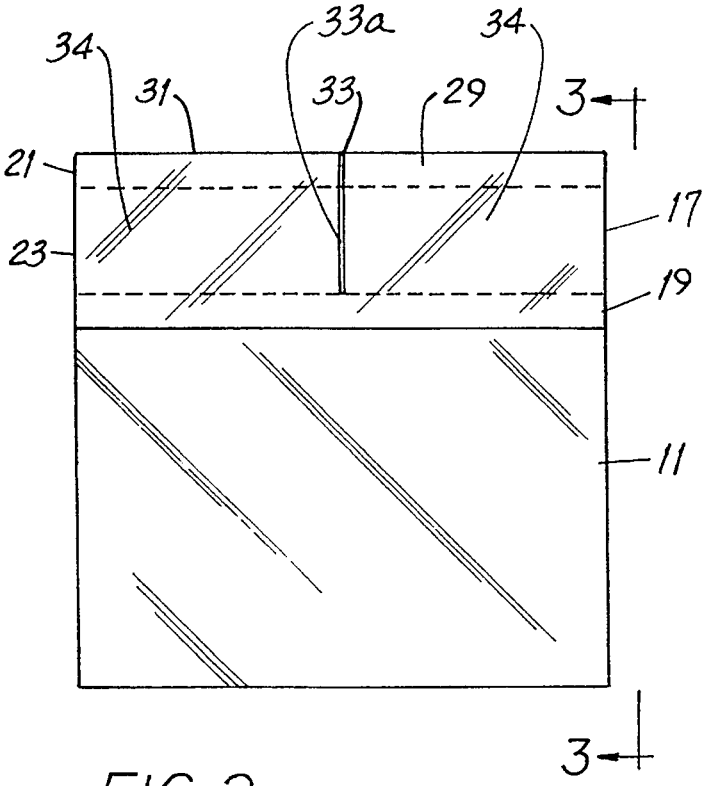
FIG. 2
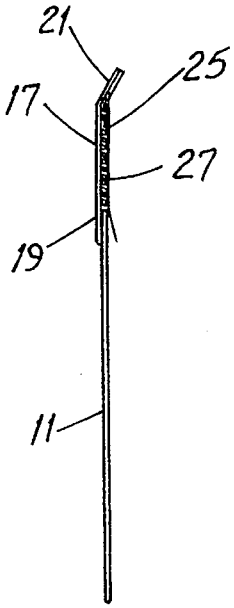
FIG. 3

APPARATUS FOR BINDING SHEET-LIKE ARTICLES

This application is a continuation-in-part of application Ser. No. 08/298,781, filed on Aug. 31, 1994, pending, which was a continuation-in-part of application Ser. No. 08/231,425, filed on Apr. 22, 1994, now abandoned.

FIELD OF THE INVENTION

This invention relates generally to bookbinding and, more particularly, to binding using adhesives.

BACKGROUND OF THE INVENTION

Binding together of sheet-like articles such as pages of a book may be accomplished in a number of ways. Some are relatively complex and require machinery. Of course, commercial bookbinders (for either new books or books under repair) usually employ such machinery and pages are permanently bound in the book.

On the other hand, there are situations where it is desirable to bind sheet-like articles together but acquisition of bookbinding machinery is out of the question or at least not warranted. For example, persons who take or otherwise obtain candid photographs often find it desirable to bind such photos between covers to form a book-like arrangement.

Such an arrangement protects the photos, helps prevent loss and retains the order of arrangement. The latter may be important in, say, describing a sequence of events such as a vacation trip. Several arrangements are provided including the system disclosed in the parent application, which are useful to bind or hold together post cards, photos, business cards and the like. Additionally, other sheet-like articles to be bound together in aligned, stacked arrangement include writing tablet sheets, business forms and the like can be bound using similar type arrangements.

A variety of such systems and arrangements exist for binding together sheet-like articles, each of which include various features. Generally, such systems include a front and back cover and a spine member, or self-adhering strip portion of the spine member usually includes an adhesive surface protected by a release liner.

Certain disadvantages arise when such binding arrangements are utilized. This is particularly true with respect to self-applied, pressure-adhering devices used by "amateur binders," e.g., persons wishing to bind photos of their grandchildren.

Unlike instances where machinery is employed to secure sheets for and during binding, several of the self-applied binders are very tricky to use. One must stack and carefully align the articles, e.g., documents or photos, and while holding them in precise arrangement between a pair of covers, neatly and squarely apply a self-adhering strip along the aligned edges of the articles to be bound together.

Even though the strip may be "pre-attached" to one of the covers and need only be adhered to the other, this task requires a good deal of manual dexterity and is not easily accomplished. And if one's ability to securely "clamp" a stack of articles together is a bit impaired, this adds another dimension of complexity.

Two common (and related) "flaws" can occur. One is that the strip is "out of square" when applied and does not fully contact and secure one of the covers. The other is that because the strip is not straight along the aligned edges, the strip has a fold or crease along it and does not contact and secure the articles to be bound as well as possible. Even disregarding the fact that "components" of the articles and binder may not be as well secured as possible, the arrangement is aesthetically less pleasing that it might be.

A primary cause of such flaws is the difficulty in aligning the edges of the articles to be bound and supporting the articles in such aligned position while a strip is affixed. It is difficult to manage the necessary manipulation of the spine member or strip with one hand while the other hand continues to grasp or otherwise hold the stack in alignment. Further, as the strip is affixed, individual sheets in the stack may tend to slip down out of alignment. Even with articles like photos, binding problems occur. And as the articles become larger (or at least where the corresponding edge of the article become longer) binding becomes more cumbersome, and flaws more likely. A new arrangement or apparatus which addresses some of these disadvantages would be an important advance in the art.

OBJECTS OF THE INVENTION

It is an object of the invention to provide an apparatus and method for binding sheet-like articles which overcomes some of the problems and shortcomings of the prior art.

Another object of the invention is to provide an apparatus and method for binding sheet-like articles wherein the resulting "assembly" more positively retains such articles.

Another object of the invention is to provide an apparatus and method for binding sheet-like articles which adequately supports the articles for binding.

Still another object of the invention is to provide an apparatus and method for binding sheet-like articles which results in an aesthetically-pleasing finished binding.

Another object of the invention is to provide an apparatus and method for binding sheet-like articles which evenly aligns the edges of the articles for binding.

How these and other objects are accomplished will become more apparent from the following descriptions and from the drawing.

SUMMARY OF THE INVENTION

The invention involves an apparatus for supporting a group of sheet-like articles for binding. It overcomes certain well-known problems and deficiencies of the prior art including those outlined above. An important aspect of the invention is the ability to support documents to be bound for binding with an adhesive spine member. Another important aspect of the invention is the ability to quickly and easily align the edges of articles to be bound and support the articles to be bound in such edge aligned position for more accurate and effective binding.

The novel apparatus of the present invention includes first and second holding members defining a first slot therebetween. This slot has a first fixed dimension. The apparatus also preferably includes a third holding member spaced from the second holding member and defining a second slot therebetween. The second slot also has a second fixed dimension. Such an arrangement provides support for groups of sheet-like articles of differing thickness so that they may be bound. Typically, the articles include lateral edges and bottom edges. In a preferred embodiment, the holding members extend away from a base member whereby the bottom edges of the articles may be aligned prior to binding.

The apparatus of the present invention provides maximum support particularly when the articles are to be bound with an adhesive spine member. When such an arrangement is used it is preferable that the apparatus include a smooth edge for urging the spine member into firm adhering contact with the articles. In such an embodiment the back member is generally normal to the holding members and the smooth edge is on the back member.

Optionally, the apparatus can include an adhering pad or other suitable arrangement for securing the apparatus to a work surface. This minimizes or prevents movement of the apparatus when in use.

In a preferred embodiment of the inventive apparatus includes a base member, a first holding member perpendicular to the base member and a second holding member disposed perpendicular to the base member and parallel to the first holding member. In this embodiment, the first and second holding members are spaced from one another in fixed relationship to form a first slot of predetermined width therebetween, whereby a plurality of articles to be bound may be positioned in the slot for alignment.

Such an embodiment can further include a third holding member perpendicular to the base member and parallel to the second holding member. In such an embodiment, the second and third holding members are also spaced from one another in fixed relationship to form a second slot therebetween. This second slot has a width different than the width of the first slot.

Such an embodiment can also include a back member generally normal to the base member and to the holding members whereby each slot is substantially bounded by the back member.

In an alternative embodiment the apparatus is particularly useful for supporting a group of photographs for binding. Such an apparatus includes a plurality of generally planar holding members spaced from one another to define narrow, medium and wide slots therebetween. Specifically, the narrow slot has a width slightly greater than the thickness of a stack of twelve photographs, the medium slot has a width slightly greater than the thickness of a stack of twenty-four photographs, and the wide slot has a width slightly greater than the thickness of a stack of thirty-six photographs.

Again, such an embodiment preferably includes a back member and a base member, each extending generally normal to the holding members for aligning the lateral and bottom edges of the photographs prior to binding.

After placing the articles between the covers and aligning the covers and articles preparatory to final binding, the apparatus holds the covers and articles in alignment. The user is then free to manipulate the spine member to bind the articles. When binding is complete, such spine member adheres to and secures the articles and the covers together.

The apparatus can be sized to accommodate articles of dimensions including those which are larger than candid photos and which have commonly-aligned edges. Such documents may be 8½ inches by 11 inches in size, for example, although other dimensions are possible.

Further details of the invention are set forth in the following detailed description and in the drawing.

BRIEF DESCRIPTION OF THE DRAWINGS

FIG. 1 is an isometric view of sheet-like articles, e.g., photographs, bound together using a binding system.

FIG. 2 is a plan view of one cover of a binding system with one strip of a spine member adhering thereto.

FIG. 3 is an edge view of the cover and spine member of FIG. 2 taken along the viewing plane 3—3 thereof.

DETAILED DESCRIPTION OF PREFERRED EMBODIMENTS

Figure 4:
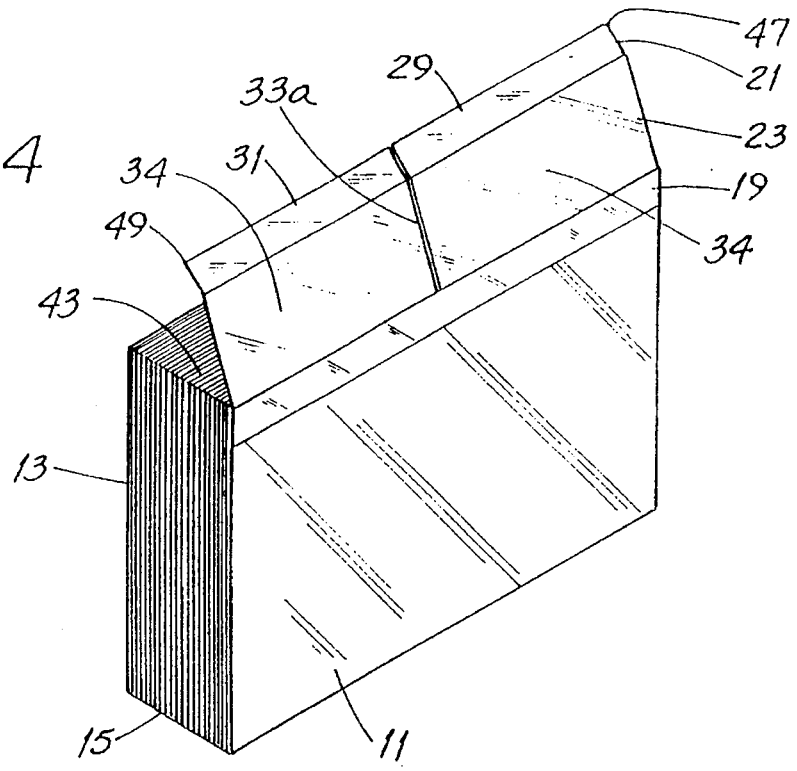
FIG. 4 is an isometric view of sheet-like articles in an intermediate stage of being bound together using the inventive system.

Before describing details of the inventive apparatus 57, it will be helpful to have an appreciation of how a set of articles appears when bound. As shown in FIG. 1, the binding systems 10 commonly utilized with the apparatus 57 have a front cover 11 and a back cover 13 between which is placed a group of sheet-like articles 15. The sheet-like articles include bottom edges 42 and top edges 43 and lateral edges 58. A strip-like spine member 17 adheres to both covers 11, 13 and to the articles 15 and binds them together "book-like" for easy article display.

In one particular system 10, as shown in FIGS. 2 and 3, the spine member 17 has a front cover-adhering strip 19 and a rear cover-adhering strip 21 spaced apart by a medial portion 23. When the system 10 is sold, one of the strips, e.g., strip 19, is preferably pre-attached to the corresponding cover 11 by adhesive. The medial portion 23 and the other strip 21 are covered by pressure-sensitive tape 25 overlaid by a release liner 27. Such liner 27 releasably adheres to the tape 25 and protects the spine member 17 from inadvertently sticking to some object other than the intended articles 15 and binder cover 13.

To facilitate binding, as shown in FIGS. 1, 2 and 4, such strip 21 is preferably divided into at least two portions 29, 31 by one or more lateral cuts or slits 33 in the strip 21. Similarly, the medial portion 23 is divided by a slit **33*a* into at least two segments 34. The release liner 27 may also be divided by the slits 33 and 33*a*** or may be one piece.

Figure 5:
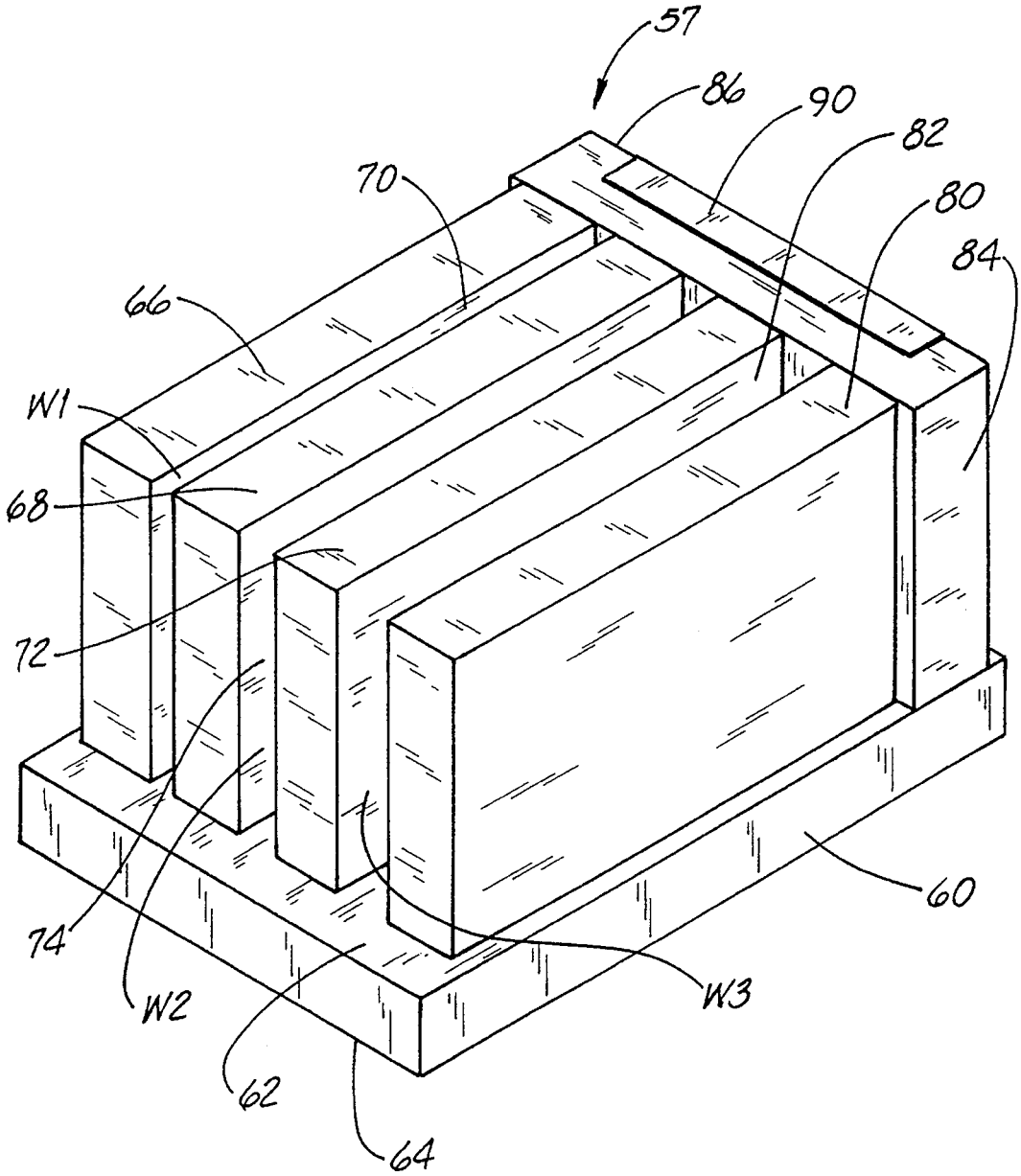
FIG. 5 is an isometric view of the apparatus of the present invention.
Figure 6:
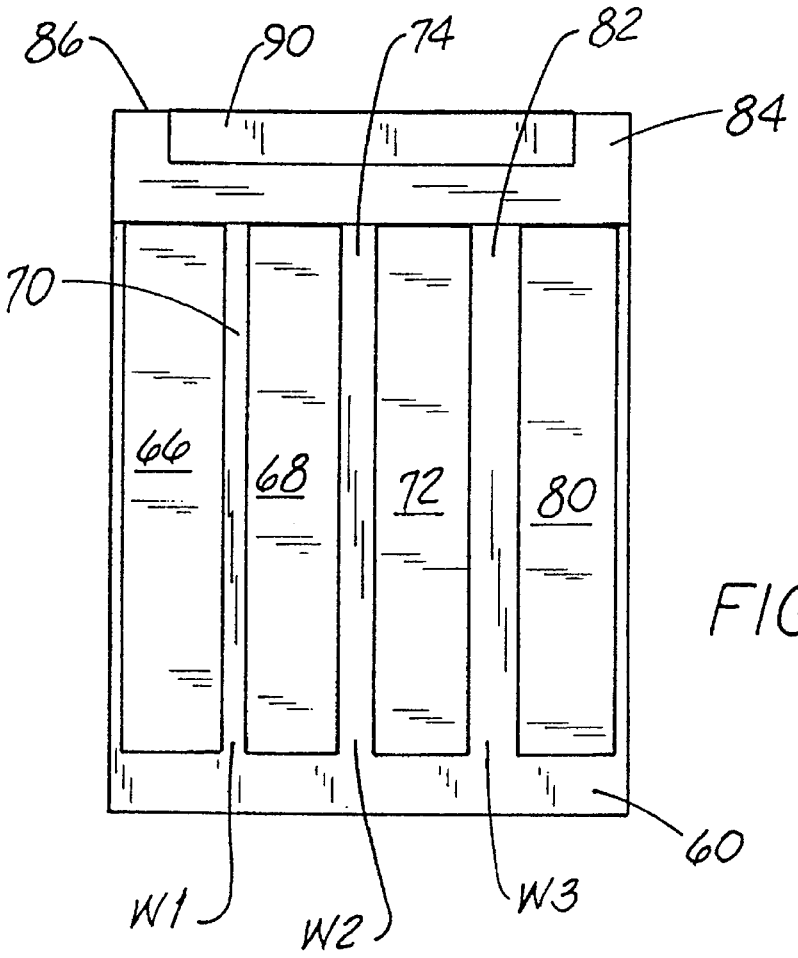
FIG. 6 is a top plan view of one embodiment of the apparatus of the present invention.

As best seen in FIG. 5, the apparatus 57 of the present invention includes a base member 60 having a top surface 62 and a bottom surface 64. A first holding member 66 extends away from the base member and is disposed perpendicular thereto. The apparatus also includes a second holding member 68 which extends away from the base member and is disposed perpendicular to base member 60. Second holding member 68 is disposed parallel to first holding member 66. First and second holding members 66 and 68, respectively, are spaced from one another in a fixed relationship to form a first slot 70 of predetermined width W1 therebetween. Apparatus 57 further includes a third holding member 72 that extends away from base member 60 and is disposed perpendicular thereto. Third holding member 72 is disposed parallel to second holding member 68. Second and third holding members 68 and 72, respectively, are spaced from one another in fixed relationship to form a second slot 74 therebetween having a width W2 different than width W1 of first slot 70. Preferably, apparatus 57 further includes a fourth holding member 80 extending from base member 60 and perpendicular thereto. Fourth holding member 80 is disposed parallel to third holding member 72. Third and fourth holding members 72 and 80 are spaced from one another in a fixed relationship to form a third slot 82 therebetween having a width W3 different than widths W1 and W2. In preferred embodiments, the apparatus additionally includes a back member 84 normal to base member 60 and to holding member 66, 68, 72 and 80. As best seen in FIG. 6, back member 84 bounds each slot 70, 74 and 82.

Figure 8:
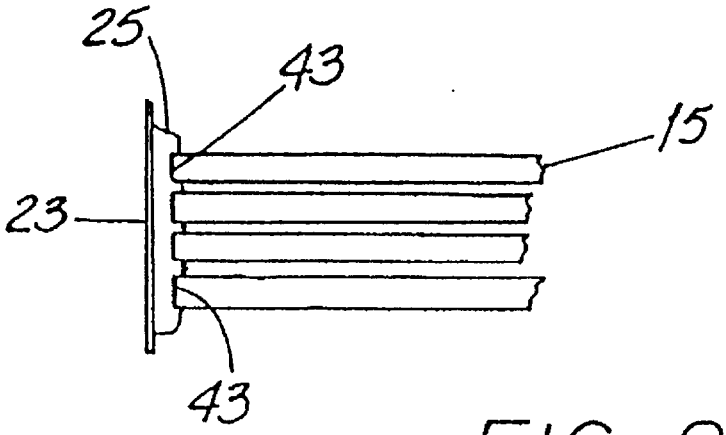
FIG. 8 is an edge elevation view showing the system spine member in conjunction with articles being bound.

As best shown in FIG. 5, back member 84 includes a smooth edge 86 disposed along the back portion thereof. Smooth edge 86 can be provided by the material of which the back member is made. Alternatively, a coating or tape 90 can be affixed to edge 86 of the back member. Such tape 90 provides a low friction surface which will assist in binding a spine member to the edges 43 of the articles to be bound. Preferably, tape 90 is ultra-high molecular weight (UHMW) polyethylene. Such UHMW polyethylene is available from DeWall, Inc. Such coating or tape 90 can be approximately 3–20 millimeters (mm) thick, and preferably 5–10 mm thick. Smooth edge 86 or tape 90 is used by applying pressure to the bound articles 15 at edges 43 after a spine member 17 has been affixed. This pressure is applied as edges 43 are moved across edge 86 or tape 90. In that way, each edge 43 of article 15 may be urged into the adhesive of tape 25 to a slight depth as best seen in FIG. 8. In that way, each article 15 is well secured but, notwithstanding, each such article 15 may be easily withdrawn from the tape 25 so that such article 15 may be replaced with a different one.

Figure 7:
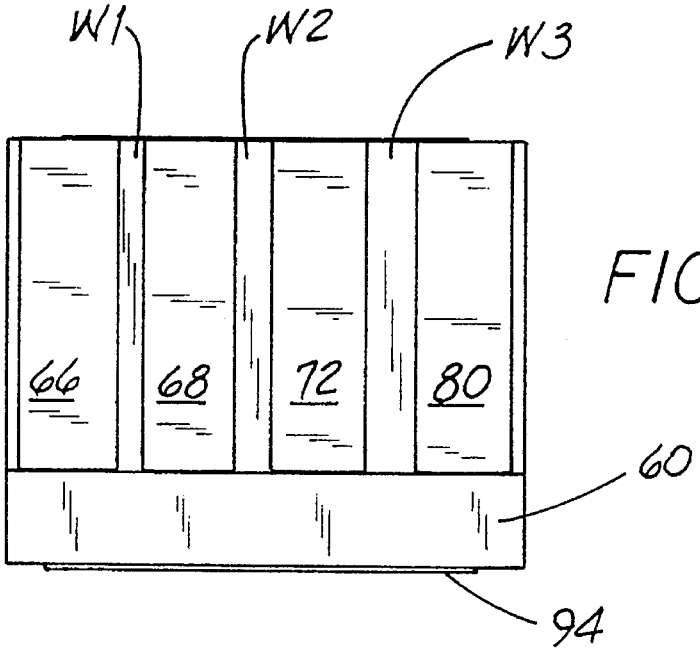
FIG. 7 is an edge elevation view of the apparatus of the present invention.

Additionally, as best shown in FIG. 7, base member 60 can include an adhesive coating or adhering pad 94 along bottom surface 64. Such adhesive coating or adhering pad 94 secures the apparatus to a work surface. Alternatively, nails, screws or other means for securing can be utilized to position and secure the apparatus 57 on a work surface. This reduces or eliminates movement of apparatus 57 during use and allows for more accurate binding.

In one embodiment shown in FIG. 6, the generally planar holding members 66, 68, 72 and 80 are spaced from one another to define narrow, medium and wide slots therebetween having widths W1, W2 and W3. The narrow slot has a width W1 of approximately 3–8 mm. Preferably W1 is slightly greater than the thickness of a stack of 12 photographs. The medium slot has a width W2 of approximately 6–12 mm. Preferably W1 is slightly greater than the thickness of a stack of 24 photographs. The wide slot has a width W3 of approximately 9–15 mm. Preferably W3 is slightly greater than the thickness of a stack of 36 photographs. Such an embodiment provides for use of apparatus 57 for binding of photographs which commonly come in 12, 24 and 36 exposures. Such articles 15 have a standard size (or a few standard sizes) and for a given size have substantially the same dimension along a top edge 43.

Figure 9:
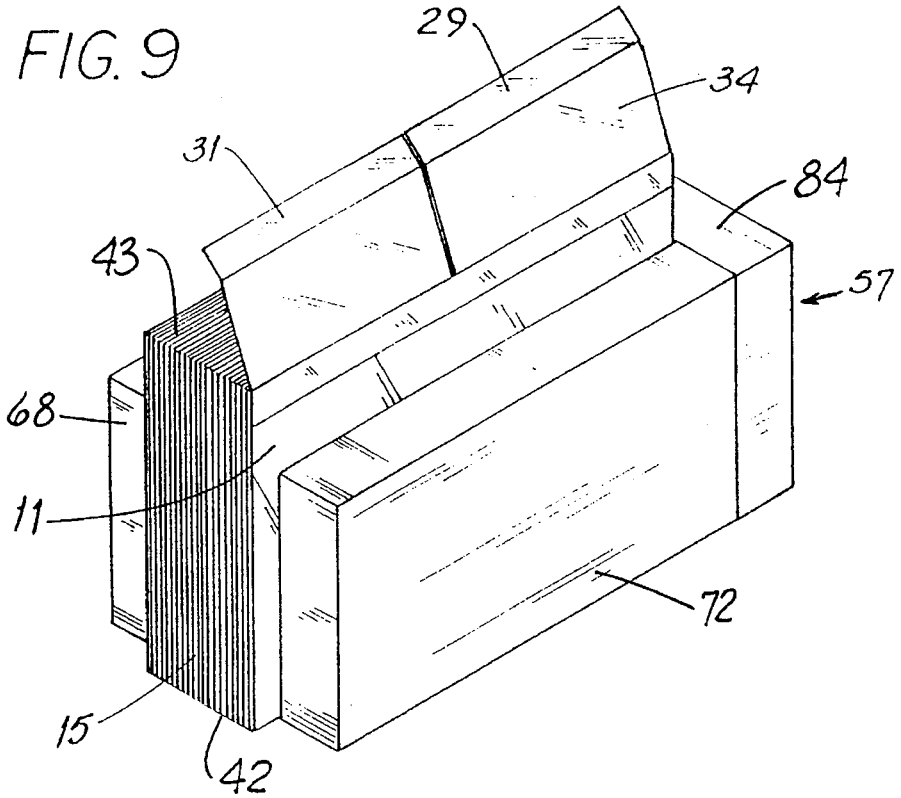
FIG. 9 is an isometric view of the apparatus shown in conjunction with a stack of articles and a binding system.

In an alternative embodiment shown in FIG. 9, apparatus 57 includes at least two holding members 68 and 72 and a back member 84. Such embodiment does not include a base member, but rather relies on the work surface, which is preferably flat, to aid in alignment of the bottom edges 42 and corresponding top edges 43.

In one binder system of the type useable with the inventive apparatus shown in FIG. 4, the exemplary binding system 10 includes a pair of covers 11, 13 and a spine member 17 having a cover-adhering strip 21 divided into at least a first portion 29 and a second portion 31. The strip 21 has a pair of ends 47, 49 spaced apart by about the same dimension and for articles 15 of postcard or photo size, such strip 21 need only be divided into easily-applied portions 29, 31 by a single cut or slit 33 about midway between the ends 47, 49.

Figure 10:
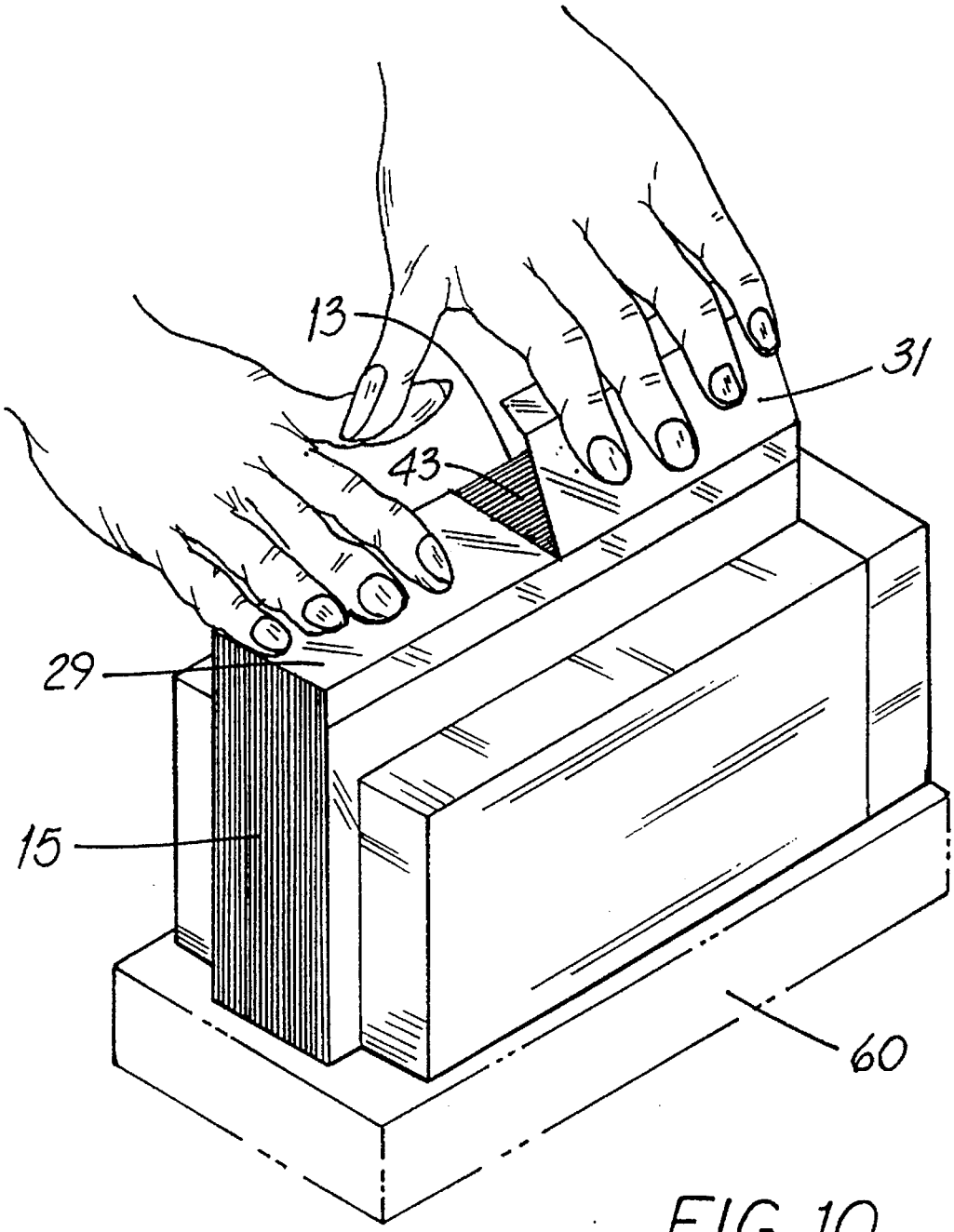
FIG. 10 is an isometric view of the apparatus in conjunction with a stack of sheet-like articles in an intermediate stage of being bound together.

In use, as shown in FIGS. 9 and 10, when a binding system 10 described above is utilized, covers 11 and 13 are placed on each side of the articles 15 and the stack is inserted into an appropriate slot. As shown in the embodiment of FIG. 10, bottom edges 42 and thus top edges 43 are urged into alignment by manual pressure on the stack urging the bottom edges against base member 60. Alternatively, as shown in the embodiment of FIG. 9, bottom edges 42 and thus top edges 43 are urged into alignment by manual pressure on the stack urging the bottom edges against the work surface. In these embodiments, lateral edges 58 are urged into alignment by manual pressure towards back member 84. Binding then proceeds as seen in FIG. 10, where a first portion 29 of strip 21 is applied to a cover 13 with medial portion 23 adhering to top edges 43. Second portion 31 is then applied to the same cover 13 in a similar manner. Smooth edge 86 or tape 90 can then be used to provide for more adequate contact of the edges 43 with the tape 25.

The apparatus 57 is also very useful for binding articles such as documents which are larger than photos or postcards and which have commonly-aligned edges. Such documents may be 8½ inches by 11 inches in size, for example. In that instance, the apparatus includes holding members, a base member and back member of appropriate dimensions to adequately support and align the documents as appropriate for the articles.

It should be noted that apparatus 57 can be utilized with any number of binder systems or arrangements which include a spine member or strip used to secure edges of sheet-like articles to be bound.

The invention addresses and largely if not entirely eliminates the problem of trying to align and hold a stack of articles in such aligned position for binding. The invention permits a user to employ both hands to properly position and affix a spine member to a stack of articles.

While the principles of the invention have been described in connection with specific embodiments, it is to be understood clearly that such embodiments are by way of example and are not limiting.

What is claimed:

1. An apparatus for supporting a group of articles for binding comprising:

a base member;

a first holding member perpendicular to the base member;

a second holding member disposed perpendicular to the base member and parallel to the first holding member, the first and second holding members being spaced from one another in fixed relationship to form a first slot of non-adjustable width therebetween, and a third holding member perpendicular to the base member and parallel to the second holding member, the second and third holding members being spaced from one another in fixed relationship to form a second slot therebetween having a non-adjustable width different than the width of the first slot, whereby a plurality of articles to be bound are positioned in the slot for alignment.

2. The apparatus of claim 1 further comprising a back member generally normal to the base member and to the holding members whereby each slot is substantially bounded by the back member.

3. The apparatus of claim 2 wherein:

the articles are to be bound with an-adhesive spine member;

the apparatus includes at least one smooth edge spaced above the base member for urging the spine member into adhering contact with the articles; and the base member includes an adhering pad for securing the apparatus to a work surface.

4. The apparatus of claim 1 in combination with the articles to be bound and wherein:

the articles are to be bound with an adhesive spine member; and the apparatus includes at least one smooth edge spaced above the base member for urging the spine member into firm adhering contact with the articles.

5. The combination of claim 4 wherein:

the apparatus has a back member generally normal to the holding members; and the smooth edge is on the back member.

6. An apparatus for supporting a group of photographs for binding and including:

a plurality of generally planar holding members spaced from one another to define narrow, medium and wide slots therebetween, and wherein:

the narrow slot has a width in the range of approximately 3–8 millimeters for binding a stack of twelve photographs;

the medium slot has a width in the range of approximately 6–12 millimeters for binding a stack of twenty-four photographs; and the wide slot has a width in the range of approximately 9–15 millimeters for binding a stack of thirty-six photographs.

7. The apparatus of claim 6 including a back member and a base member, each extending generally normal to the holding members for aligning the lateral and bottom edges of the photographs prior to binding.

* * * * *